United States Patent [19]

Okamoto et al.

[11] Patent Number: 4,585,326

[45] Date of Patent: Apr. 29, 1986

[54] DEVELOPING ELECTROPHOTOGRAPHIC IMAGE USING MAGNETS AND MAGNETIC MATERIAL

[75] Inventors: Yukio Okamoto, Hachioji; Kiyoshi Kimura, Iruma; Tadashi Miwa, Hino; Noriyoshi Tarumi; Masakazu Fukuchi, both of Hachioji; Kunio Ito, Tama; Hiroshi Fuma, Hachioji, all of Japan

[73] Assignee: Konishiroku Photo Industry Co., Ltd., Tokyo, Japan

[21] Appl. No.: 598,869

[22] Filed: Apr. 11, 1984

[30] Foreign Application Priority Data

Apr. 14, 1983 [JP] Japan ..... 58-66078

[51] Int. Cl.[4] ..... G03G 15/08

[52] U.S. Cl. ..... 355/3 DD; 355/3 DR; 355/3 BE; 355/14 D; 118/657

[58] Field of Search ..... 355/3 DD, 14 D, 3 DR, 355/3 BE; 118/657, 658

[56] References Cited

U.S. PATENT DOCUMENTS

| | | | |
|---|---|---|---|
| 3,826,570 | 7/1974 | Kolibas | 355/3 DR |
| 4,292,386 | 9/1981 | Tarano | 355/3 DR |
| 4,299,474 | 11/1981 | Ernst et al. | 355/3 DR |
| 4,357,093 | 11/1983 | Caudill et al. | 355/3 DR X |
| 4,357,103 | 11/1982 | Kroll | 355/3 DD |
| 4,365,888 | 12/1982 | Hosaka et al. | 355/14 R |

*Primary Examiner*—A. C. Prescott

*Attorney, Agent, or Firm*—Jordan B. Bierman

[57] ABSTRACT

A recording apparatus wherein an electrostatic latent image on an electrostatic latent image retaining member is developed into a visible image by means of a developer transported on the surface of a developer carrier having at least a magnet movably provided therein. At least a part of the electrostatic latent image retaining member is constituted by a magnetic material.

6 Claims, 12 Drawing Figures

DEVELOPING ELECTROPHOTOGRAPHIC IMAGE USING MAGNETS AND MAGNETIC MATERIAL

BACKGROUND OF THE INVENTION

1. Field of the Invention

The present invention relates to a recording apparatus employing an electrostatic latent image retaining member.

2. Description of the Prior Art

First of all, a recording apparatus employing an electrostatic latent image retaining member will be briefly described hereinunder.

A reproducing apparatus, which effects reproduction by exposing a document through scanning, consists of the following description: when a document to be reproduced is mounted on a document glass plate and a reproducing button is depressed, while irradiating the document an exposure lamp travels in a predetermined direction, together with an optical system including a reflecting mirror and other optical members. The reflected ray of light, corresponding to the shade of the document, is applied through the optical system to an electrostatic latent image retaining member (e.g., a photosensitive drum) which is uniformly charged, thereby allowing an electrostatic latent image to be formed on the electrostatic latent image retaining member. Moreover, a toner image corresponding to the shade of the document is formed on the electrostatic latent image retaining member by means of a developer.

On the other hand, a recording medium (e.g., a reproducing sheet of paper) is fed from a feeder so as to be coincident with the toner image position on the electrostatic latent image retaining member and comes in contact with the electrostatic latent image retaining member. Then, the toner image formed on the surface of the electrostatic latent image retaining member is transferred to the reproducing sheet by means of a transfer electrode. In the meantime, the electrostatic latent image retaining member continues rotating in a predetermined direction, and the toner image is gradually transferred to the reproducing sheet. Thereafter, the reproducing sheet having the toner image transferred thereto is separated from the electrostatic latent image retaining member and fed to a fixing device. This fixing device, e.g., a roller fixing device which is constituted by two rollers, at least one of which is heated, fixes the image formed by the developer to the reproducing sheet on heating. Thereafter, the reproducing sheet is delivered to the outside of the recording apparatus body.

A developing device, in the recording apparatus constructed as above, which develops the latent image formed on the electrostatic latent image retaining member into a visible image by means of a developer will be explained hereinunder in more detail.

The electrostatic latent image retaining member is uniformly charged and then exposed correspondingly to the reflected ray image. Consequently, the electrostatic latent image retaining member has on its surface, portions retaining electrostatic charges and portions retaining no electrostatic charges, thereby to form a latent image. When a developer comes in contact with the electrostatic charge retaining portions, the developer (a toner in the case of a two-component developer; and a one-component toner in the case of a one-component developer) is attracted by means of an electrostatic force between the charges of the latent image and the charges of the developer to develop a visible image formed by the developer (toner) on the electrostatic latent image retaining member. The visible image (toner image) is transferred to a reproducing sheet in the subsequent step.

The toner is consumed by adhering to the charged portions of the electrostatic latent image retaining member, that is, through development and therefore must be refilled according to the number of reproductions.

As a developing means to attain the above object, a magnetic brush developing device is generally known and frequently employed.

FIG. 1 schematically shows a magnetic brush developing device.

The following description is in the case of a one-component magnetic developer.

As a magnetic developer 14 (the developer is employed to mean a one-component magnetic toner in the following description) is carried on the peripheral surface of a developer carrier 13 incorporating therein a rotatable magnet 16 and the magnet 16 is rotated in the direction of the illustrated arrow, the developer 14 is carried in the direction opposite to the direction of rotation of the magnet 16 along the peripheral surface of the developer carrier 13. If an electrostatic latent image retaining member 9 is provided in close proximity to this developer carrier 13, the developer 14 carried along the peripheral surface of the developer carrier 13 comes in contact with the electrostatic latent image retaining member 9 at a developing area C. When the electrostatic force between the charges of the charged portions (electrostatic charge retaining portions) of the electrostatic latent image retaining member 9 and the charges of the developer 14 is larger than the magnetic force of the developer carrier 13 which attracts the developer 14, the developer 14 is transferred from the developer carrier 13 to the electrostatic latent image retaining member 9 to adhere thereto, thereby to form a visible image on the electrostatic latent image retaining member 9, which latent image is transferred to another member, such as a reproducing sheet or the like, in the subsequent step.

If the electrostatic latent image retaining member 9 having a latent image formed thereon and the developer 14 do not sufficiently come in contact with each other, the developer 14 will not adhere to the whole surface of the charged portions of the electrostatic latent image retaining member 9, resulting in the formation of a coarse visible image on the electrostatic latent image retaining member 9. Such an undesirable phenomenon occurs, as a matter of course, due to lack of the developer 14 on the developer carrier 13. In the conventional magnetic brush developing device, however, the above-mentioned phenomenon may occur even when there is a sufficient amount of the developer 14 on the developer carrier 13.

As the result of a close observation of the magnetic brush developing device in its developing state, the present inventors have found out that a visible image is formed on the electrostatic latent image retaining member 9 in such a process as mentioned hereinafter.

As shown in FIG. 2, the developer 14 is carried along the peripheral surface of the developer carrier 13 in the direction opposite to the direction of rotation of the magnet 16 in the state where a thick layer of the developer 14 is formed above each of magnetic poles A of the magnet 16, while a thin layer of the developer 14 is formed above each of areas B between the adjacent magnetic poles.

In addition, as shown in FIG. 3, only when inside magnetic pole area A surrounding inside the developer carrier 13 passes developing area C, and the layer of the developer 14 is sufficiently thick, will the electrostatic latent image retaining member 9 and the developer 14 come in contact with each other (wherein, the contact is effected through only a short width l). However, as shown in FIG. 4, when each area B between the adjacent magnetic poles passes developing area C, the layer of the developer 14 is thin and, therefore, no developer 14 is substantially in contact with the electrostatic latent image retaining member 9. Moreover, even when the magnetic poles of magnetic 16 face the electrostatic latent image retaining member 9, the magnetic lines of force produced from one magnetic pole which extend toward the electrostatic latent image retaining member 9 are smaller in number than those toward the adjacent opposite magnetic poles. The degree of concentration of the developer 14 is substantially proportional to the magnetic flux density of the magnetic pole. Therefore, even if one magnetic pole N passes to the developing area C as shown in FIG. 3, when the magnetic flux density is low, the developer 14 is not sufficiently concentrated on the part above the magnetic pole N, resulting in a reduction in the width l of the area of contact between the electrostatic latent image retaining member 9 and the developer 14. Accordingly, even if a charged portion of the electrostatic latent image retaining member 9 passes the developing area C, the developer 14 is not sufficiently attracted, so that the visible image formed by the developer 14 becomes coarse, undesirably.

The present inventors have devised a recording apparatus which makes it possible to increase the magnetic flux density on the electrostatic latent image retaining member at the developing area to obtain a high-density recording, even when the conventional magnetic brush developing device, for example, is employed to form a visible image on the electrostatic latent image retaining member.

SUMMARY OF THE INVENTION

A primary object of the invention is to provide a recording apparatus wherein an electrostatic latent image on an electrostatic latent image retaining member is developed into a visible image by means of a developer carried on the surface of a developer carrier having at least a magnet rotatably provided therein, characterized in that at least a part of the electrostatic latent image retaining member is constituted by a magnetic material.

The above and other objects, features and advantages of the invention will become apparent from the following description taken in conjunction with the accompanying drawings.

DESCRIPTION OF THE PREFERRED EMBODIMENT

Figure 5:
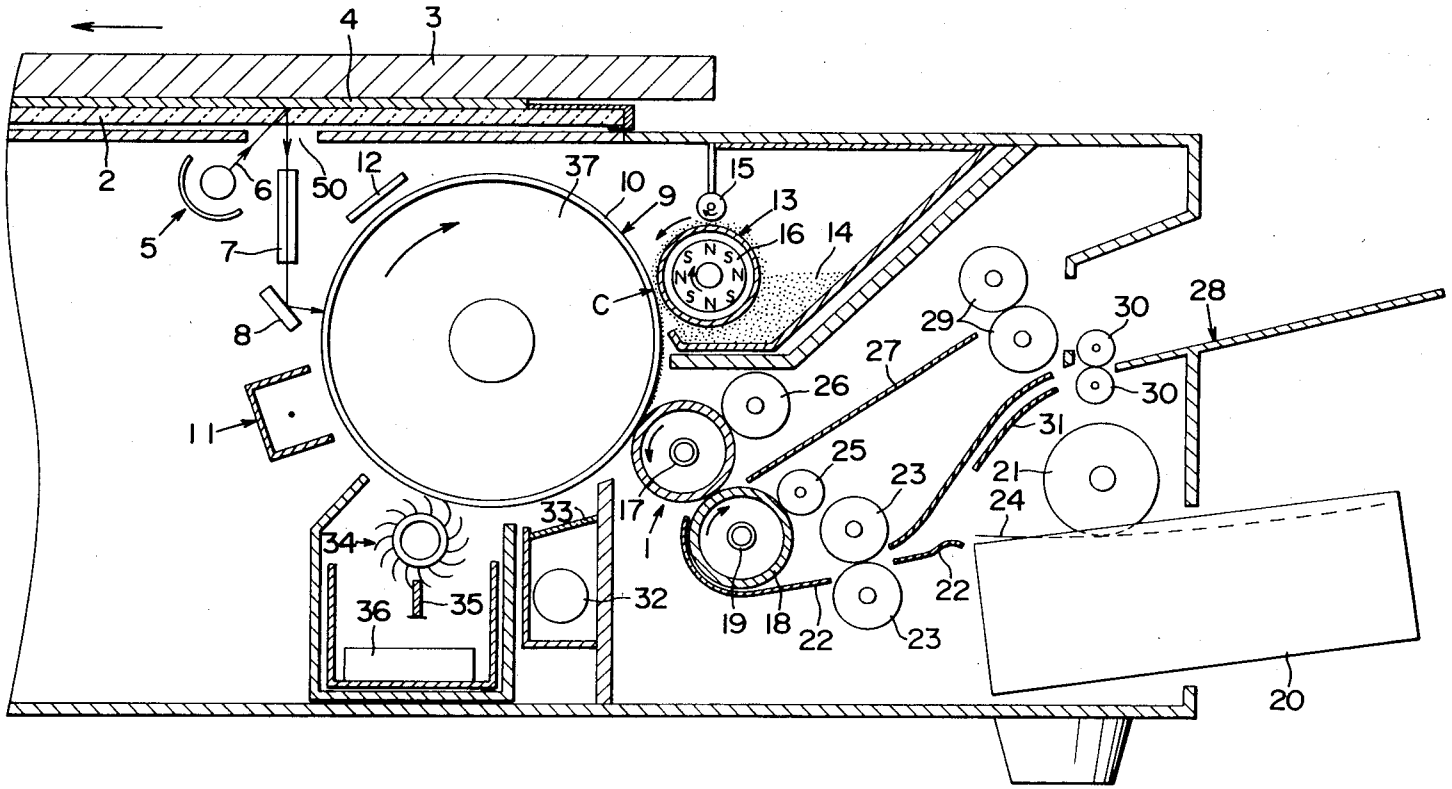
FIG. 5 is a schematic sectional view of a press transfer system reproducing machine as recording apparatus employing a photosensitive drum having a part constituted by a magnetic layer in accordance with the invention.

FIG. 5 shows an essential part of a press transfer system electrophotographic reproducing machine as an example of the recording apparatus incorporating therein an electrostatic latent image retaining member (referred to as "photosensitive drum", hereinafter) in accordance with an embodiment of the invention.

In this reproducing machine, a document 4 covered with a platen cover 3 is mounted on the glass surface of a document glass plate 2 movably provided on the upper wall portion of the body. The document 4 is irradiated with a ray of light 6 from a light source 5 inside the body through a slit 50 provided in the upper wall portion of the body. The ray reflected from the document 4 is passed through an SLA (SELFOC lens array) 7 and reflected by means of a mirror 8 so as to be incident on a photosensitive drum 9. In consequence, a photosensitive layer 10 of selenium, organic photoconductive substance or the like provided on the drum 9, which is uniformly charged, is exposed in the pattern corresponding to the document picture image through the movement of the document glass plate 2 in the direction of the illustrated arrow, thereby allowing an electrostatic latent image to be formed on the photosensitive layer 10. A reference numeral 11 in the Figure denotes a corona charger, which electrically charges the whole surface of the photosensitive layer with a predetermined polarity in the unexposed state. In addition, a reference numeral 12 represents a device which is constituted by a light-emitting diode or electroluminescence panel for preventing the formation of any undesirable black lines or frame and which serves to extinguish the charges accumulated on the any other portions that the picture image area on the photosensitive drum 9 thereby to prevent the toner from adhering to the non-picture image area. The photosensitive drum 9 formed with the electrostatic latent image is supplied with a known electrically conductive toner 14 from a developer carrier (referred to as "developing sleeve", hereinafter) 13. This toner 14 is carried along the surface of the sleeve 13 while being regulated in thickness by means of a magnetic roll 15 for regulating the toner thickness. The toner carrying force is applied by the rotation of the sleeve 13 and that of a magnet roll 16 inside the sleeve 13. Since the toner 14 has inverse charges produced therein through induction by the electrostatic latent image on the photosensitive drum 9, toner particles are successively attracted to move onto the photosensitive drum 9 in proportion to the amount of charges of the electrostatic latent image, to form a toner image in a predetermined pattern, thereby to effect development.

The thus formed toner image is then press-transferred to an intermediate transfer roll 1 in contact with the photosensitive drum 9 under a linear pressure not exceeding about 0.5 kg/cm (e.g., about 0.1 kg/cm) Since the roll 1 has a surface layer containing silicone rubber of additive polymerization type as its main component, the roll 1 fully exfoliates the toner particles on the photosensitive drum 9. The exfoliated toner particles are carried to the position of a subsequent press roll 18 while being preheated on the roll 1 to a predetermined temperature (i.e., such a temperature that the toner satisfactorily displays its release properties) by means of a heater lamp 17 inside the roll 1. The press roll 18 is heated to a predetermined temperature by means of a heater lamp 19 provided therein and adapted to lead a reproducing sheet 24, which is fed from a feed box 20 by means of a feed roll 21 through a guide plate 22 and a transport roller 23, into the area between the rolls 1 and 18 while heating the reproducing sheet 24. Accordingly, the reproducing sheet 24 has a temperature high enough for transfer of the toner image and therefore allows the toner image, which has been already preheated until this time when the reproducing sheet 24 is led in the area between the rolls 1 and 18, to be separated or transferred from the roll 1 to the reproducing sheet 24, as well as permits the toner image to be simultaneously fixed on the reproducing sheet 24. It is to be noted that in the Figure: a reference numeral 25 denotes a cleaning roller for the press roll 18; 26 a cleaning roller for the intermediate transfer roll 1; 27 a guide plate for feeding the reproducing sheet 24, after fixing, to a delivery roller 29 disposed closer to a delivery tray 28; 30 a roller for delivering the reproducing sheet from the bottom part of the delivery tray 28 in the double-side copying operation; and 31 a guide plate employed in the double-side copying operation.

In the stage subsequent to the intermediate transfer roller 1, the photosensitive drum 9 is irradiated with a ray of light from a charge erasing lamp 32 through a transparent filter 33 to erase the charges remaining on the drum 9. Moreover, the photosensitive drum 9 is contacted by a cleaning member 34 constituted by a fur brush. The residual toner particles thereby separated are collected on a collecting magnet 36 by means of a scraping lever 35.

It is to be noted in the above-mentioned reproducing machine that a one-component magnetic toner is employed as the developer 14, and at least a part of the photosensitive drum 9 is constituted by a magnetic material.

In the case where the photosensitive drum 9 is developed by employing, particularly a one-component electrically conductive magnetic toner, the toner layer is formed as a single-particle layer or a thin layer close thereto. Therefore, the picture image finally developed on the reproducing sheet has an extraordinarily excellent quality and is excellent also in development stability and developer durability. In addition, such a one-component electrically conductive magnetic toner is applicable to from low- and intermediate-speed developments to a high-speed development. Employment of this toner is particularly preferable in that an excellent transfer can be effected for any transfer material.

However, even if a one-component electrically conductive magnetic toner is employed to develop the latent image formed on the photosensitive drum 9, the above-mentioned favorable characteristics cannot be well achieved unless the photosensitive drum 9 and the developer 14 sufficiently come in contact with each other; therefore, if the latent image is developed, only a coarse visible image can be formed on the photosensitive drum 9.

In view of the above, according to the invention, the substrate of the photosensitive drum is comprised of a magnetic layer in order to obtain a satisfactory contact between the photosensitive drum and the developer at the developing area C. However, such a structure may be employed wherein the magnetic layer is not provided as the substrate itself but is thinly provided on the conventional substrate (Al), and a photosensitive layer is provided on the thin magnetic layer.

Figure 6:
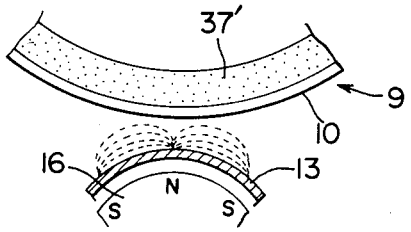
FIG. 6 PRIOR ART
FIGS. 6 and 7 schematically show the magnetic lines of force in the case where the photosensitive drum is provided with no magnetic layer and in the case where the magnetic layer is provided thereon, respectively.
Figure 7:
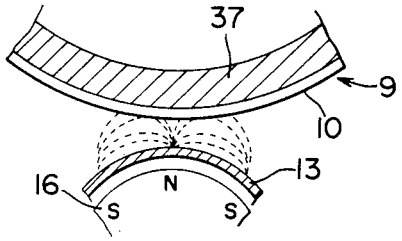

FIG. 6 shows the photosensitive drum 9 in the case where a non-magnetic material (including paramagnetic material) 37', for example Aluminum, is provided as the substrate of the photosensitive drum 9, while FIG. 7 shows the photosensitive drum 9 in the case where a magnetic layer 37 having a ferromagnetic material at least in a part thereof is provided as the substrate of the photosensitive drum 9. If the magnetic layer 37 is provided as the substrate of the photosensitive drum 9, when the photosensitive drum 9 and one of the magnetic poles inside the developing sleeve 13 face each other at the developing area C as shown in FIG. 7, the magnetic lines of force produced from the magnetic pole extend toward the photosensitive drum 9 more than those in the case where the non-magnetic layer 37' is provided as the substrate of the photosensitive drum 9 (see FIG. 6). FIG. 6 shows the state of the magnetic field at the developing area C in the case where no magnetic layer is provided in the photosensitive drum 9 (the substrate 37' is a non-magnetic material), while FIG. 7 shows the state of the magnetic field in the case where the magnetic layer 37 is provided in the photosensitive drum 9 in accordance with the invention. As shown in FIG. 7, if the magnetic layer 37 is provided in the photosensitive drum 9, since the magnetic layer 37 is smaller in magnetic reluctance than the non-magnetic layer 37', the magnetic lines of force (illustrated by broken line) produced from any one of the magnetic poles of the magnetic roll 16 inside the developing sleeve 13 and extending toward the photosensitive drum 9 are larger in number than those in the case of FIG. 6. The larger the number of the magnetic lines of force extending toward the photosensitive drum 9, the higher the magnetic flux density at the magnetic pole facing the photosensitive drum 9, and the larger the amount of the developer 14 concentrated thereon. Accordingly, the thickness of the developer 14 above the magnetic pole facing the photosensitive drum 9 is larger than that of the developer 14 above the magnetic pole not facing the photosensitive drum 9.

More specifically, the the case where the magnetic layer 37 is not provided in the photosensitive drum 9, the layer thickness of the developer 14 above each magnetic pole of the developing sleeve 13 when the magnetic pole faces the photosensitive drum 9 is substantially equal to that of the developer 14 when the magnetic pole is not at the facing position. In the case where the magnetic layer 37 is provided in the photosensitive drum 9, however, the layer thickness of the developer 14 above the magnetic pole facing the photosensitive drum 9 is larger than that of the developer 14 when the magnetic pole is not at the facing position. In this way, the layer thickness of the developer 14 above the magnetic pole facing the photosensitive drum 9 is made sufficiently large, so that when the developer is carried through the gap between the photosenstive drum 9 and the developer sleeve 13 by the rotation of the magnetic poles inside the developing sleeve 13, the developer 14 can satisfactorily contact the photosensitive drum 9 even in the region where the photosensitive drum 9 and the developer 14 cannot come in contact with each other according to the conventional technique. It is thereby possible to enlarge the effective width l of the developing area.

Figure 8:
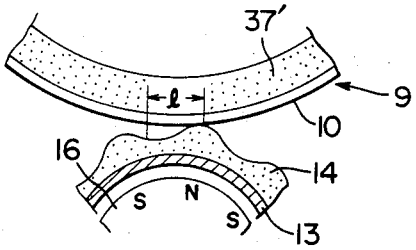
FIG. 8 PRIOR ART
FIGS. 8 and 9 schematically show the effective developing width in the case where the photosensitive drum is provided with no magnetic layer and in the case where the magnetic layer is provided thereon, respectively.
Figure 9:
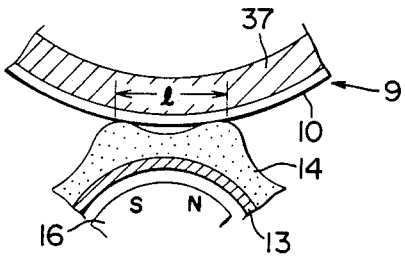

In the prior art in which the magnetic layer 37 is not provided on the photosensitive drum 9, as shown in FIG. 8, the developer 14 above the magnetic pole facing the photosensitive drum 9 cannot have a sufficiently large thickness; hence, the effective width l of the area of contact between the photosensitive drum 9 and the developer 14 is relatively small. However, as shown in FIG. 9, the provision of the magnetic layer 37 on the photosensitive drum 9 makes it possible to increase the layer thickness of the developer 14 above the magnetic pole facing the photosensitive drum 9; therefore, it is understood that the effective width l of the area of contact between the photosensitive drum 9 and the developer 14 is enlarged correspondingly.

According to the experiments carried out by the present inventors, when the diameter of the photosensitive drum was 120 mm; the diameter of the developing sleeve was 30 mm; and as the magnet an eight-pole magnet of 1,000 gauss was employed, although the effective width of the developing area was 5.5 mm in the prior art, the effective width was enlarged to 9.5 mm in the case where the magnetic layer 37 was provided on the photosensitive drum 9.

Figure 11:
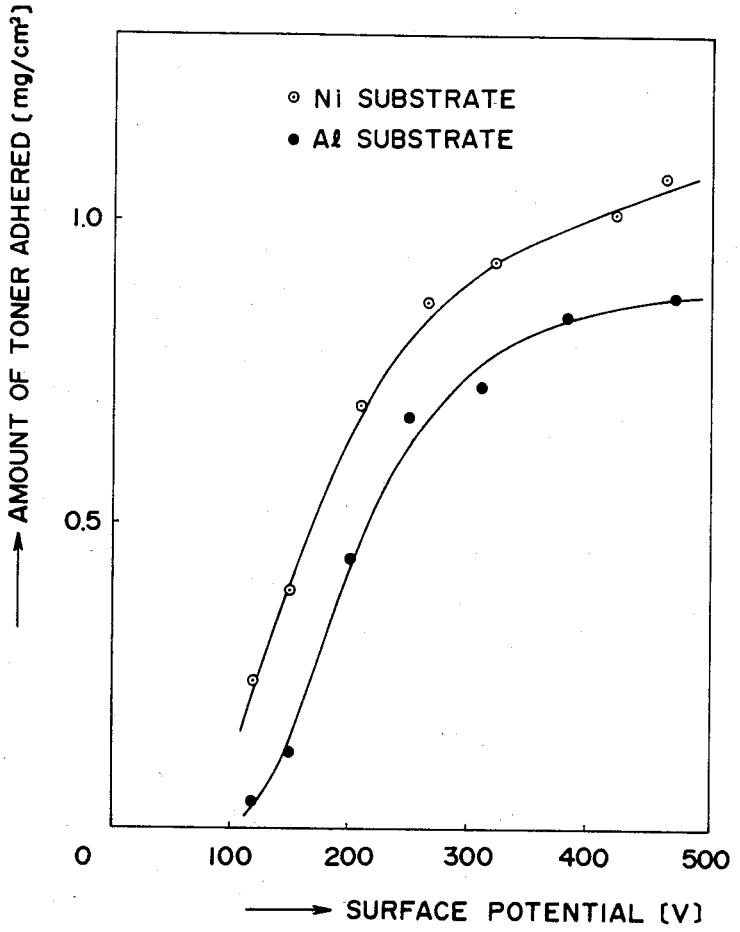
FIG. 11 is a graph for comparison of the toner adhesion amount between aluminum and nickel employed as materials for the substrate of the photosensitive drum.

FIG. 11 shows the difference in the amount of developer 14 adhering to the photosensitive drum 9, between the photosensitive drum having the substrate 37' of aluminum in accordance with the prior art and the photosensitive drum employing the substrate 37 of nickel in accordance with the embodiment of the invention. It is understood from FIG. 11 that the photosensitive drum employing nickel is larger in the amount of the developer 14 adhering thereto regardless of the surface potential of the photosensitive drum 9.

The intermediate transfer system reproducing machine in accordance with this embodiment is advantageous, since when the toner image is transferred to the reproducing sheet, the reproducing machine employs only the adhesive force of silicone rubber or the like to transfer the toner image, without employing any static electricity, which is inevitably used in the electrostatic transfer system.

There are various means for providing the magnetic layer 37 in a part of the photosensitive drum 9.

Figure 10:
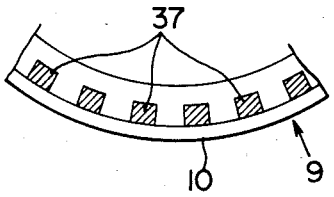
FIGS. 10(A) and 10(B) show the magnetic layer partially localized in an electrostatic latent image retaining member, respectively.
Figure 10:
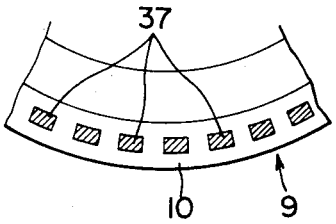

A photosensitive layer may be formed on the surface of an Ni endless belt manufactured by electroforming or a magnetic drum-substrate (Fe, Sus, Cr, Ni or the like). Alternatively, such a means may be employed that the surface of a drum substrate made of a non-magnetic material is coated with a magnetic material, such as Ni or the like, by plating to provide a magnetic layer, on which a photosensitive layer is formed. In addition, it is also possible to provide the magnetic layer 37 in the photosensitive drum 9 by attaching a sheet photosensitive material to a magnetic drum. Further, a powder magnetic material may be dispersed into a part of a photosensitive drum substrate layer or the whole of the substrate layer (non-illustrated). Furthermore, a magnetic material may be equally localized periodically in some parts of a metal, which is not ferromagnetic, or a resin as shown in FIGS. 10(A) and 10(B).

Formation of an electrically conductive layer as an electrode of the photosensitive drum 9 and an insulating layer for holding the surface charges accumulated when the surface of the photosensitive drum 9 is exposed, makes it possible to obtain a high-density recording; therefore, a further effective operation can be effected.

Figure 1:
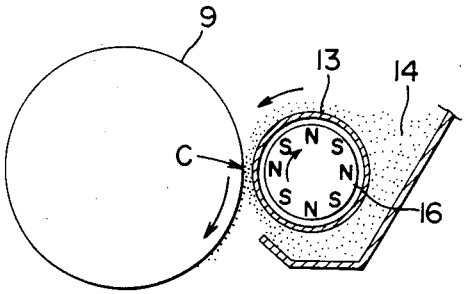
FIG. 1 PRIOR ART
FIG. 1 schematically shows a magnetic brush developing device.
Figure 3:
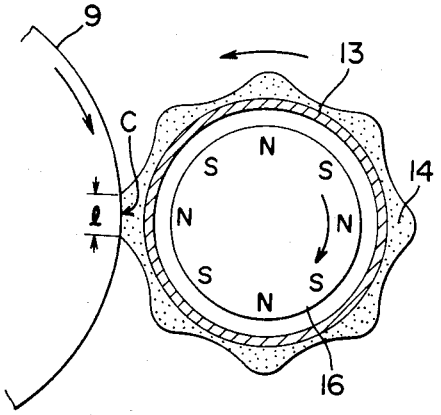
FIG. 3 PRIOR ART
FIGS. 3 and 4 schematically show the states of the developer at a developing area different from each other due to the positions of magnetic poles in the developer carrier, respectively.
Figure 2:
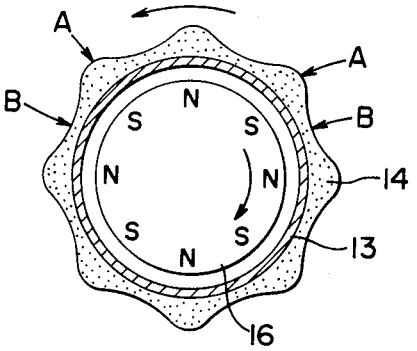
FIG. 2 PRIOR ART
FIG. 2 shows how a developer is carried along the surface of a developer carrier.
Figure 4:
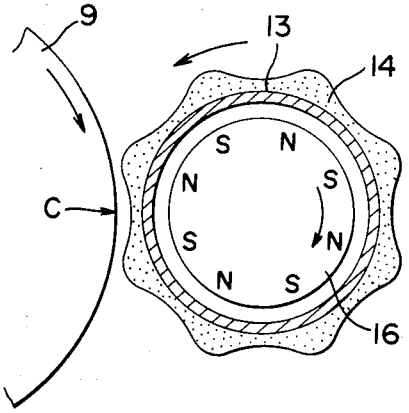
FIG. 4 PRIOR ART

It is to be noted that although in the magnetic brush developing device in the above-described embodiment, the rotation of the developing sleeve 13 is counterclockwise, and the rotation of the magnetic poles of the magnet therein is clockwise (as viewed in FIG. 1), in the invention the rotational directions of both of them are not especially limitative to those mentioned above. Even if both the rotational directions are the same, the effective width l of the area of contact between the photosensitive drum 9 and the developer 14 is larger than that in the prior art.

The embodiment has been described with respect to the electrophotographic reproducing machine according to the Carlson method in which Se, OPC, Cds or the like is employed as a photosensitive material, particularly to the press transfer system electrophotographic machine. According to the technical idea of the invention, however, the embodiment is also applicable to an ordinary electrostatic transfer system reproducing machine, and an electrostatic recording system reproducing machine in which the electrostatic latent image retaining layer is comprised of a dielectric material and is made to carry charges by means of the multistylus method or the like.

It is to be noted that although the above-described magnetic layer is provided all over the periphery of the photosensitive drum, the magnetic layer may be provided only in the area to be developed (i.e., in the case where the area for forming an electrostatic latent image is predetermined), and in this sense, the magnetic layer may be provided only in a part of the whole periphery of the photosensitive drum.

When the electrostatic latent image retaining member having no magnetic layer is developed by means of the magnetic brush developing device, a coarse visible image is formed on the electrostatic latent image retaining member, since the effective width of the area of contact between the electrostatic latent image retaining member and the developer which contributes to development is small. In particular, when a one-component magnetic developer is employed as the developer, the developer is formed on the electrostatic latent image retaining member as a single-particle layer or a thin layer close thereto. Consequently, if the effective width, which contributes to development, is small, a charged area of the electrostatic latent image retaining member may have a portion to which no developer adheres, resulting in the formation of a coarse visible image.

However, even when a one-component magnetic developer is employed, the provision of the magnetic layer on the electrostatic latent image retaining member makes it possible to enlarge the development effective width of the area of contact between the electrostatic latent image retaining member and the developer; therefore, the developer satisfactorily adheres to the charged area to permit a high-density recording to be effected.

In addition, although it is desirable that the distance between the electrostatic latent image retaining member and the developer carrier should be equal at all times, there is no such a case, in practice, that both of them rotate with an equal distance therebetween at all times, owing to variations in mechanical accuracy or other factor. Any change in distance between the electrostatic latent image retaining member and the developer carrier affects the development effective width: if both the members separate from each other, a light visible image is formed on the electrostatic latent image retaining member; and if both the members approach each other, a dark visible image is formed on the electrostatic latent image retaining member. Thus, any change in distance between both the members has an effect on the shade of recording.

The provision of the magnetic layer on the electrostatic latent image retaining member as in the invention makes it possible to enlarge the development effective width, so that it is possible to obtain a satisfactory contact between the electrostatic latent image retaining member and the developer. Accordingly, the adverse effect due to variations in distance between the electrostatic latent image retaining member and the developer carrier is reduced. In consequence, even if the distance between both the members changes, a visible image reduced in picture quality change is formed on the electrostatic latent image retaining member. Thus, it is possible to obtain a uniform recording on the recording medium to which the image is transferred from the electrostatic latent image retaining member.

What is claimed is:

1. A recording apparatus comprising an image retaining member adapted to retain an electrostatic latent image thereon, and a developer carrier having therein a magnet rotatably arranged and facing said image retaining member for carrying a developer to develop the electrostatic latent image, said magnet having thereon different poles arranged alternately and uniformly around the entire periphery of said developer carrier, and a magnetic material uniformly displaced around the entire periphery of a image retaining member.

2. A recording apparatus according to claim 1, wherein said magnetic material is uniformly dispersed in a substrate layer of said image retaining member.

3. A recording apparatus according to claim 1, wherein said magnetic material is constituted uniformly in said electrostatic latent image retaining member.

4. A recording apparatus according to claim 1, wherein said magnetic material is constituted periodically in said electrostatic latent image retaining member.

5. A recording apparatus comprising an image retaining member adopted to retain thereon an electrostatic latent image, a developer carrier having therein a magnet rotatably arranged and facing said image retaining member for carrying a developer to develop the electrostatic latent image, said magnet having thereon different poles arranged alternately and uniformly along the entire periphery of said developer carrier, a magnetic material uniformly displaced along the entire periphery of said image retaining member, and said recording apparatus being adapted to employ a one-component magnetic developer as said developer.

6. A recording apparatus according to claim 1, wherein said developer carrier has a rotating sleeve.

* * * * *